US006412661B1

(12) United States Patent
Hannah, Sr.

(10) Patent No.: US 6,412,661 B1
(45) Date of Patent: Jul. 2, 2002

(54) PLASTIC PAINT CONTAINER WITH REDUNDANT CLOSURE, SPILL RESISTANT POUR SPOUT AND LIQUID RECOVERY

(76) Inventor: Robert E. Hannah, Sr., 112 Laramie Dr., Victoria, TX (US) 77904

( * ) Notice: Subject to any disclaimer, the term of this patent is extended or adjusted under 35 U.S.C. 154(b) by 0 days.

(21) Appl. No.: 09/392,597

(22) Filed: Sep. 9, 1999

(51) Int. Cl.[7] ..... B67D 1/16

(52) U.S. Cl. ..... 222/111; 220/304; 220/760; 220/771; 222/571

(58) Field of Search ..... 220/304, 771, 220/761, 755, 783, 695, 696, 699, 700, 760; 215/329; 222/111, 571

(56) References Cited

U.S. PATENT DOCUMENTS

| | | | | | |
|---|---|---|---|---|---|
| 2,207,210 | A | * | 7/1940 | Knauf | 220/799 |
| 2,715,480 | A | * | 8/1955 | Livingstone | 222/111 |
| 3,198,377 | A | * | 8/1965 | Buckley | 220/771 |
| 3,628,612 | A | * | 12/1971 | Dowson | 222/111 |
| 3,762,612 | A | * | 10/1973 | Miller | 222/479 |
| 4,548,332 | A | * | 10/1985 | Neat | 220/268 |
| 4,926,521 | A | * | 5/1990 | Gapnepain | 16/110 |
| 4,989,757 | A | * | 2/1991 | Krall | 222/111 |
| 4,993,565 | A | * | 2/1991 | Ota et al. | 215/1 C |
| 5,052,567 | A | * | 10/1991 | Colani | 215/100 |
| 5,181,615 | A | * | 1/1993 | Thompson | 220/618 |
| 5,383,558 | A | * | 1/1995 | Wilkinson et al. | 206/508 |
| 5,435,451 | A | * | 7/1995 | Dyer | 215/400 |
| 5,607,709 | A | * | 3/1997 | Fritz et al. | 426/106 |
| 5,626,258 | A | * | 5/1997 | Maiorino | 220/695 |
| 5,662,242 | A | * | 9/1997 | Steo | 220/695 |
| 5,855,299 | A | * | 1/1999 | Arnold et al. | 222/109 |
| 5,893,489 | A | * | 4/1999 | Giarrante | 222/482 |
| 5,941,422 | A | * | 8/1999 | Struble | 222/109 |
| 6,260,722 | B1 | * | 7/2001 | Ekkert | 215/331 |

* cited by examiner

*Primary Examiner*—Lee Young
*Assistant Examiner*—Joseph C. Merek

(57) ABSTRACT

A clear plastic paint container including primary container and lid, both of which are threaded. The container is unique because of the spill resistant convex pour spout, liquid recovery drain trough, redundant sealing to preserve contents and recessed molded bottom hand grip for more effective handling. The no-waste, no-special tools, no-rust, no-label obliteration, corrosion resistant, and thermal resilient advantages are just some of the auxiliary features. These enhancements by far surpass the conventional wisdom of the container industry. The use of "PETE" (Polyethylene Terephthalate) plastic or equivalent transforms this container to an eye appealing and practical alternative. The opportunity to offer such an improvement by only slightly reducing contents. The paint industry must have a keen interest in this container, not only because of the growing demand for plastic containers but also the numerous advantages listed in the summary. To those skilled in the art, these user friendly qualities and superior advantages will make this the container of choice.

7 Claims, 4 Drawing Sheets

PLASTIC PAINT CONTAINER WITH REDUNDANT CLOSURE, SPILL RESISTANT POUR SPOUT AND LIQUID RECOVERY

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to containers; metal, and more specifically plastic containers. This container as described below is primarily for paint containers equivalent but not limited to one gallon. Additionally, this container should not be limited to paint but could apply to cleaners, solvents, chemicals, etc. Metal cans have long been the standard in the paint and chemicals industry. The metal containers have conventionally press fit or friction lids and have inherent sealing problems. This invention provides for redundant sealing as the extended convex pour spout mates to the inner convex lid. Redundancy of the closure is accomplished as the threaded inner side wall of the lid is battened to the main container outside body wall. The redundant sealing further protects the integrity of the contents, thus reducing waste and cost. In addition to the sealing pitfalls, the metal cans are subject to deterioration within and outside the can. The metal cans are difficult or impossible to keep clean and contents labels often after one use are not readable. This invention provides an internal configured pour spout preventing paint overrun onto the outside of the container. Paint overrun is further contained via an internal liquid recovery drain trough. Metal cans have an inherent problem with the paint trapped under the inner top lip necessary for lid placement. This invention excludes paint entrapment areas. Metal cans have a side bail handle and flat bottom making it difficult to grasp. This invention provides a recessed molded bottom hand grip for better control while pouring. Metal cans are also subject to dents in normal transportation and handling, often resulting in reduced profits.

Plastic containers have been introduced over the years; however, they have been under-utilized in the paint industry. The recently introduced plastic containers remained within the paint industry paradigm. That paradigm being restricted to the industry standard of one gallon cans. Conventional paint industry packaging has adhered to the one gallon standard for many years. Other industries have long recognized the need to change marketing strategies to maintain a competitive edge. This invention by design drives the volume down from the one gallon standard to slightly less due to the extended convex pour spout. This proposed plastic container can maintain the overall height and circumference of a conventional one gallon container. This can be accomplished by reducing the lower body height equal to the height of the convex pour spout and recessed area dictated by the liquid recovery drain trough.

Additionally, little regard has been given to the aesthetic appeal offered by clear plastic containers. The utilization of "PETE" (Polyethylene Terephthalate) plastic or equivalent rectifies this issue. Further, with few exceptions, the plastic containers were of the snap type, friction or press fit lids. These submissions still required additional tools to open and/or did not provide adequate sealing. The previously introduced plastic containers did nothing to contain paint spillage when either mixing, pouring or brush swiping. Those skilled in the art find these drawbacks very time consuming and costly.

BRIEF SUMMARY OF THE INVENTION

The invention is comprised of a main body cylindrical container, closed bottom end, open threaded top end and constructed of "PETE" (Polyethylene Terephthalate) plastic or equivalent. The top of the inner side wall of the primary container is provided with a narrow flat lip ring for added reinforcement and further containment of contents overrun. The upper threaded end is slightly smaller in diameter so when the lid is installed the entire container is symmetrical. Configuration at the open end is reduced by the convex aperture directed inwards and upwards from the side wall. The convex aperture opening is such that a standard paint brush is easily accepted. The convex inner pour spout significantly reduces the opportunity for paint spillage onto the outside wall of the container. Within and between the inner opening and side wall, running circularly and downwardly, exists the liquid recovery drain trough. These features transform the container to a drip resistant and spill proof vessel. At the front or pour side of the container exists two "flat" paint entrapment areas capable of holding paint in the container, especially at a low contents level. To overcome these entrapments, solid tapered ridges are provided at the liquid recovery drain trough and primary container transition zone. The liquid recovery drain trough is provided with a knock-out or removable drain plug at the back side of the container. After initial commercial mixing, the drain plug must be punched through or removed from the drain trough. The entire inner portion of the container provides for added upper body strength, liquid recovery, and significantly improved brush swiping. Redundant sealing of the container is accomplished with the lid in place and fully battened. The inwardly positioned pour spout mates to the inner pliable top and the threaded inner lid mates to the primary container outer side wall; thus, accomplishing the redundant seal. The bottom back side of the container is provided with a recessed molded hand grip for improved control when pouring. The bottom of the main container may be concave for added strength.

The accompanying lid for container closure is also threaded consistent with the lower portion of the main container embodiment and also constructed of plastic, "PETE" (Polyethylene Terephthalate) or equivalent.

Listed below are advantages of this invention:

1. Eye appealing and contents can be seen without opening.
2. No drip or drip is contained in the liquid recovery drain trough. When used for chemicals, it is easier and safer to pour and environmentally safer because of containment.
3. Corrosion resistant, especially latex paints and the like.
4. Corrosion resistant to other commercial and industrial chemicals, solvents, cleaners and solutions when used in that capacity.
5. Can be permanently embossed with warnings and Department of Transportation information independent of other labeling.
6. No bent containers, damaged containers usually result in price reductions or are non-salable.
7. Paint brush swipes for excess paint are contained within convex spout opening.
8. Resilient to thermal expansion as opposed to metal containers.

9. No waste is experienced due to a damaged lid, rust contamination, or metal deterioration.
10. Contents identification are not obliterated by paint over labels.
11. No special tool(s) required for opening and closing.
12. No hammering on lid to close and splashing of paint.
13. No rust or scratches on consumer or retailer shelving.
14. Plastic is consistent with other consumer products such as solvents, insecticides, pesticides, etc.
15. Minimal clean up is required unlike clean up with conventional containers.
16. Manufactured, at least in part, with recycled plastic.
17. Defined front and back sides.
18. Easy to manually stir without spillage.
19. A second container is not required for proper mixing because of the extended convex pour spout.
20. No paint entrapment areas.

DETAILED DESCRIPTION OF THE INVENTION

Figure 1:
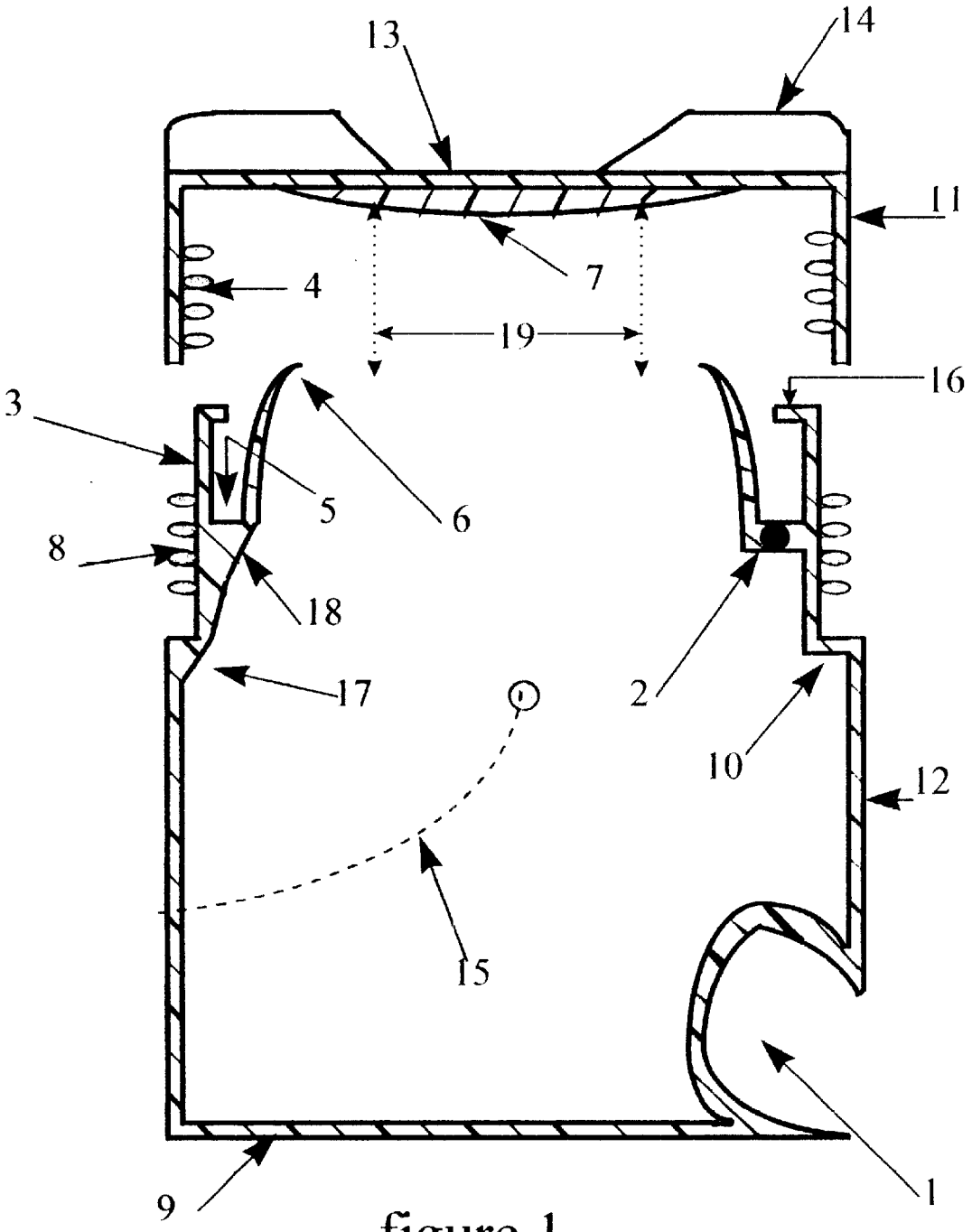
FIG. 1, Sheet 1—Illustrates a cross section and exploded view of the entire container and lid. For clarification, the container is described as left "FRONT" and right "BACK".
Figure 2:
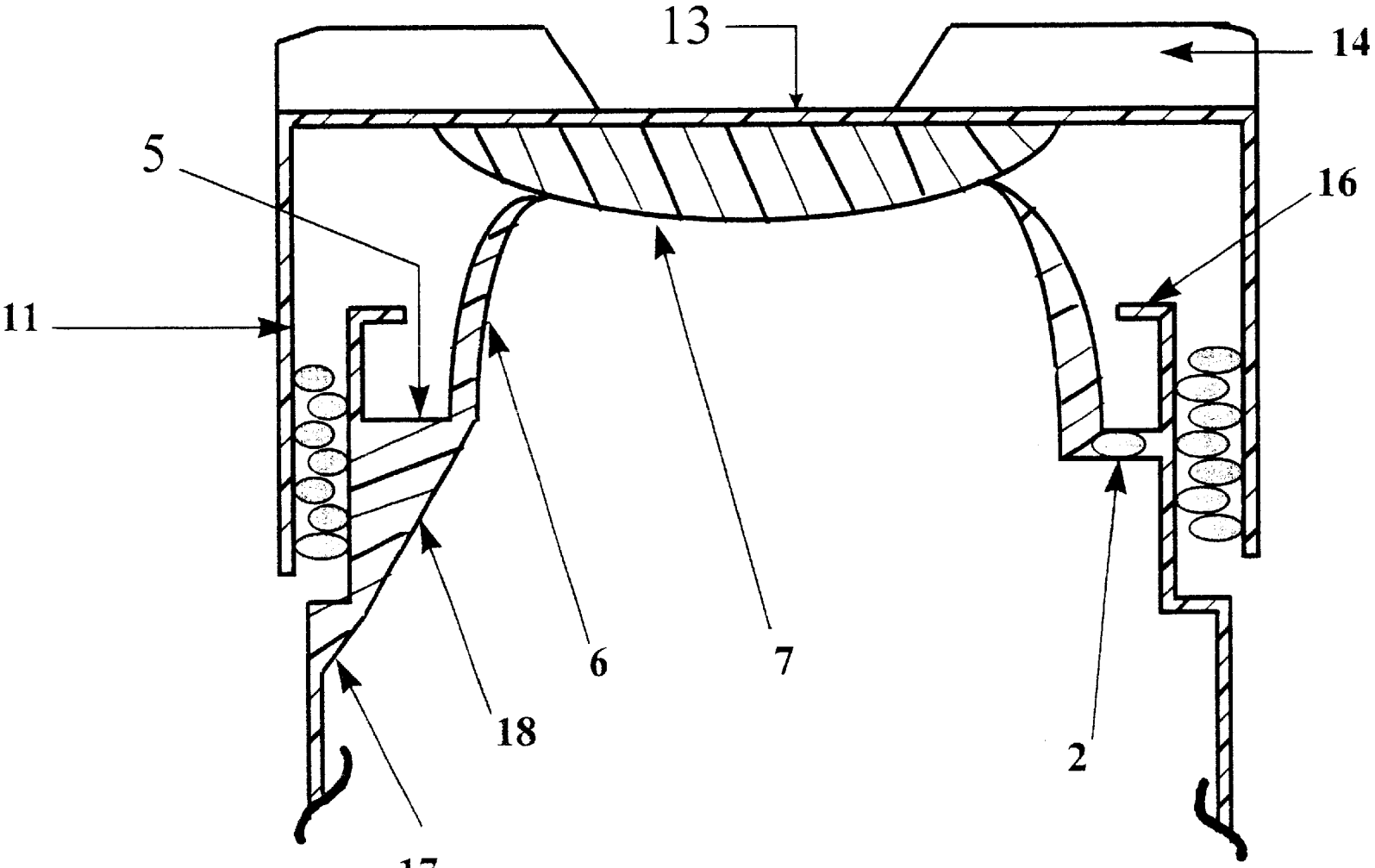
FIG. 2, Sheet 2—Illustrates a fragmented cross section of the container with the lid closed. The threaded cross section is not intended to be the actual fit configuration. This drawing is not necessarily symmetrical. The following sections are numbered to illustrate one side mirrored by the opposite quadrant; however, the liquid recovery drain trough is lower and is provided with the drain hole.
Figure 3:
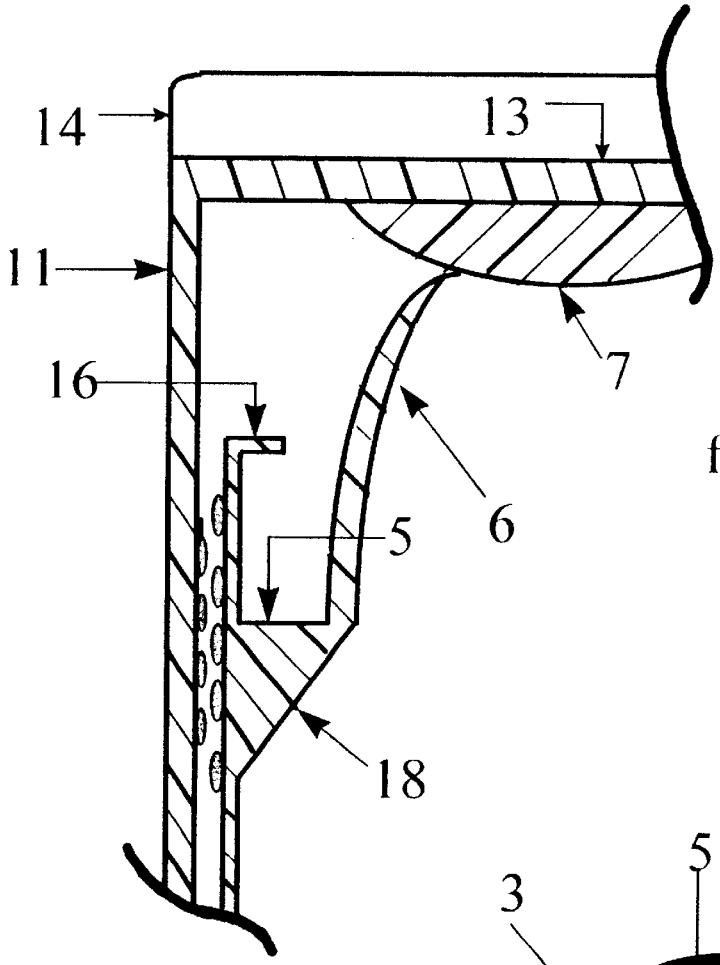
FIG. 3, Sheet 3—Illustrates a fragmented cross section of the lid and primary container in the closed position. This illustration demonstrates the alliance between the pliable inner convex surface and the extended pour spout. When fully battened, the pliable inner surface of the lid compresses the upper pour spout lip to facilitate a proper seal. Further sealing is accomplished via the threaded lid to primary container.
Figure 4:
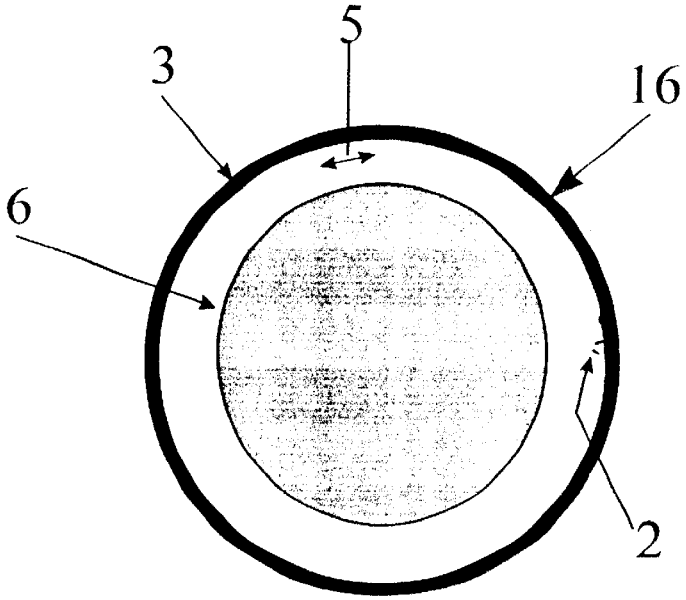
FIG. 4, Sheet 3—Illustrates a top view of the primary container with the lid removed. This illustration shows the inner pour spout (Front) in relation to the liquid recovery drain trough and drain hole (Back). In this drawing, the drain hole is referred to as the lower right side.

The invention is a plastic container constructed of "PET" (Polyethylene Terephthalate) plastic or equivalent. The container consists of a primary container or receiver and a plastic lid for closure and preservation of contents.

Primary Container:

The primary container is cylindrical in shape with a closed bottom end (9) open top end and constructed of "PET" (Polyethylene-Terethphlate) plastic or equivalent. The top of the inner side wall of the primary container is provided with a narrow flat lip ring (16) for added reinforcement and further containment of contents overrun. The container has a defined front side and back side (recessed molded bottom grip) (1). The top outside wall is threaded (8). At the threaded upper area of the container, the actual diameter is somewhat smaller than the lower area. The transition (10) of the larger diameter lower portion (12) to the smaller diameter upper portion (3) is slight, little more than the thickness of the lid, primary container wall and the threaded surfaces associated with each. This transition zone at the front quadrant of the container is constructed as a solid unit and tapered downwardly approximately 45 degrees (17). This tapered feature prevents any paint from accumulating or becoming trapped on an otherwise flat surface of the transition zone's 360 degree underside. The upper portion versus lower portion diameter differential is incorporated into the container at the stress region for added strength as well as aesthetic appeal and stacking. When fully battened and displayed, the container is symmetrically sound and stable.

Adding to the upper body strength of the primary container and the essence, in part, of the invention is the unique inner body pour spout (6) and liquid recovery drain trough (5) equipped with a drain hole (2). This feature provides a spill resistant spout rising upwardly and inwardly in a convex manner to form the spout. The spout is a 360 degree opening (19) and slightly higher than the outside cylindrical wall of the container. If viewed from the top with the lid removed, the container would appeal as a container within a container. As liquid (paint for example) is poured from the container, no direct liquid contact is made with the container outside wall. Further, the configuration of the spout is such that once pouring has ceased, no spill over the side wall will occur. The convex nature of the our spout provides the "cutting" of the liquid, thereby minimizing the opportunity for overrun. This is unique as compared to a conventional container in which the material rolls out of the container across an array of obstacles including lips and recesses in container side walls. In a conventional container, the material continues to roll over the side wall long after the pouring has ceased. If overrun was to occur, the design of the extended convex pour spout allows the material to migrate down the side of the spout still contained within the container side wall and into the liquid recovery drain trough. The same concept applies in swiping a paint brush on the inside wall of the pour spout.

The liquid recovery drain trough is a narrow lip separating the side wall of the primary container and the lower edge of the pour spout. This trough runs downward from the defined "pour" side or front of the container, 180 degrees to the opposite quandrant or back side of the container. The low point on the back side of the liquid recovery drain trough is provided with a drain hole allowing material to flow back into objective containment. The drain hole will be provided with a knock-out or removable plug. This feature is practical during commercial mixing of thick and difficult contents. The liquid recovery drain trough at the front of the container is constructed as a solid unit and tapered downwardly approximately 45 degrees (18). This tapered feature prevents any paint from accumulating or becoming trapped on an otherwise flat surface of the trough's 360 degree underside, just as in the design of transition zone. Consideration must be given to combining the transition zone and liquid recovery drain trough tapered undersides. During the manufacturing process it may be advantageous to maintain continuity from the transition zone up to and including the liquid recovery drain trough. The front quadrant of the container or approximately 60 degrees would probably suffice for exclusion of liquid traps.

Another unique and advantageous feature is the recessed molded bottom hand grip (1). When dispensing paint, one hand grasps the side bail handle (15) and the other is comfortably positioned within the recessed bottom hand grip giving ample control. If compared to a conventional paint container, the side bail handle and the flat bottom make pouring difficult and cumbersome. Those skilled in the art will easily recognize the value of the recessed bottom hand grip.

Another key feature is the provision for redundant sealing to protect contents. To accomplish the redundant seal, the container lid is threaded downwardly in a clockwise motion. As the threaded lid is nearing a fully battened position, the inner convex pour spout makes contact with the lid's inner pliable liner. When the threaded outer surfaces are fully battened, the pour spout opening is mated to the lid's pliable inner liner in a slightly compressed manner for an effective redundant seal.

Conventional paint industry packaging has adhered to the one gallon standard for many years. Other industries have long recognized the need to change marketing strategies to maintain a competitive edge. This invention by design drives the volume down from the one gallon standard to slightly less due to the extended convex pour spout. This proposed plastic container can maintain the overall height and circumference of a conventional one gallon container. This can be accomplished by reducing the lower body height equal to the height of the convex pour spout and recessed area dictated by the liquid recovery drain trough.

The Lid

The lid (11) is consistent in construction with the primary container, "PET" (Polyethylene-Terethphlate) plastic or equivalent. The lid consists of a cylindrical threaded inner side wall (4) and a top (13). The inner unique side of the top section is manufactured slightly pliable and convex (7). The significance of this convex inner body is for the redundant closure objective as detailed above. As the lid is threaded downward onto the primary container the protrusion of the inner lid contacts the primary container pour spout for a 360 degree seal. The seal is accomplished as the convex inner lid makes contact and extends partially into the primary container pour spout. This compresses the relatively thin wall of the extended pour spout into the convex inner lid.

Figure 5:
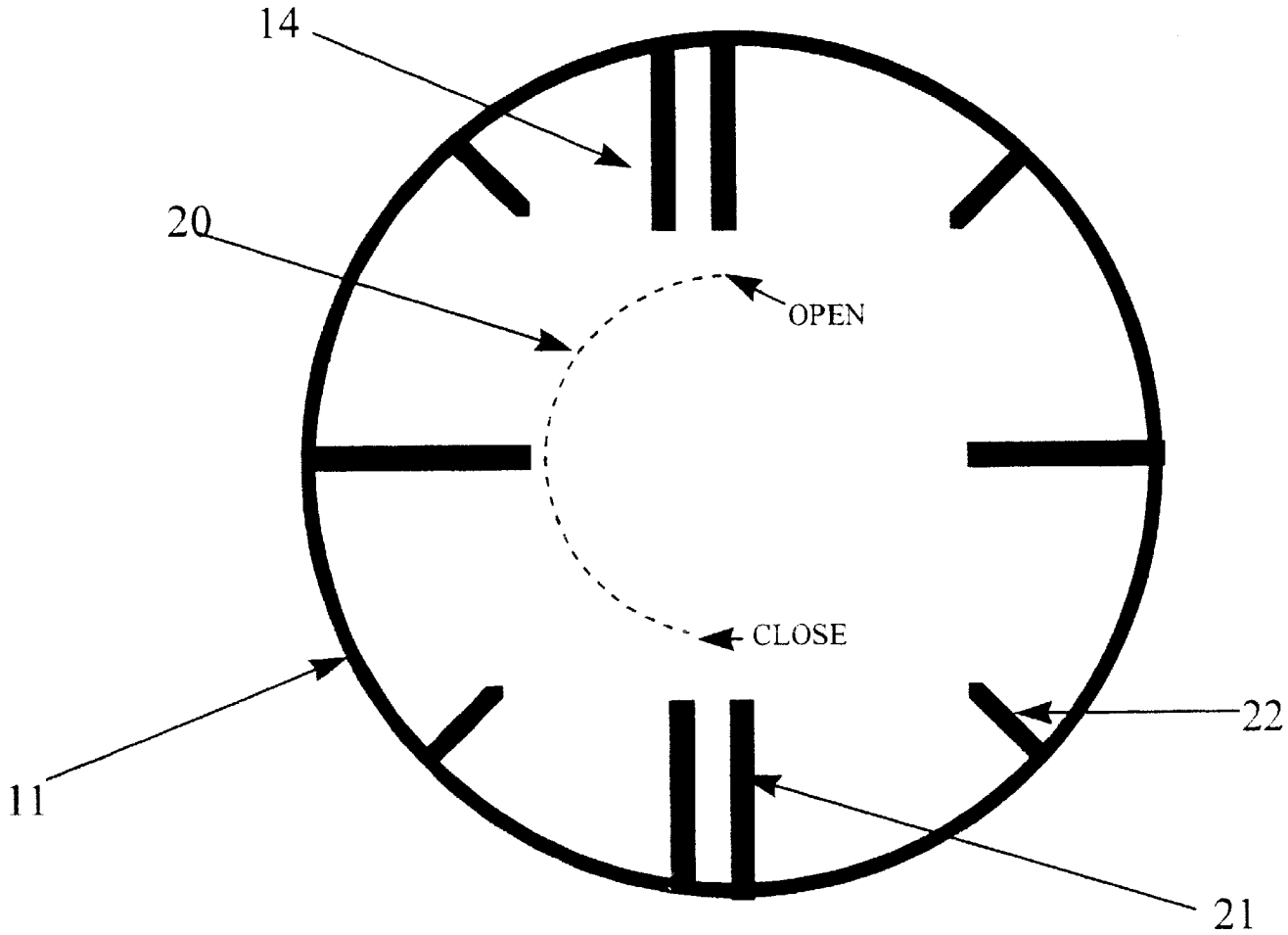
FIG. 5, Sheet 4—Illustrates the rib configuration on top of the container lid. This drawing shows symmetrically positioned ribs for stacking ease and two additional ribs allowing an optional externally sourced tool for opening or closing.

The outer portion of the lid top is provided with raised strip ribs (14). These ribs are "bar" type incorporated into the lid during the molding process. Not only do the symmetrically positioned ribs provide lid strength, they also provide an easily stackable top surface. (see FIG. 5 where stacking rib 22 and parallel rib are shown) If, assistance is necessary to open the container, the vertically and symmetrically positionetd ribs would provide adequate leverage for an optional externally sourced tool. An added feature is the embossed top stating the verbiage for opening and closing directions along with rotation arrow (20).

What I claim as my invention is as follows:

1. A container and lid in combination comprising: a cylindrical container having a threaded exterior sidewall, the sidewall having an uppermost top rim and a convex pour spout extending above said top rim, the opening at an upper end of the spout being smaller than an opening at the lower end of the spout, a drain trough including a drain hole located between the spout and the sidewall wall of the container, the drain hole communicating with an interior of the container;

a lid for closing said container, said lid having a cylindrical side wall, said side wall being threaded on an interior surface thereof, the lid having a top wall, an inner surface of said top wall of said lid having a raised and convex seal member thereon, wherein said seal sealing engages said spout when said lid is threaded on said container.

2. The combination of claim 1, where the container and the lid are made of polyethylene terepthalate.

3. The combination of claim 1, where the sidewall of container includes a recessed hand grip.

4. The combination of claim 1, where the container includes a bail handle.

5. The combination of claim 1, where the container has a stepped transition in the sidewall such that a diameter of the sidewall above the transition is smaller than a diameter of the sidewall below the transition.

6. The combination of claims 5, where the container includes a surface on the interior threreof that is inclined with respect to the side wall, said surface being below the transition and connecting the smaller diameter sidewall to the larger diameter sidewall.

7. The combination of claim 5, where the container includes a surface on the interior threreof that is inclined with respect to the side wall, said surface being below the drain trough and connecting the trough to the smaller diameter sidewall.

* * * * *